US007980922B2

(12) United States Patent
Kiesel et al.

(10) Patent No.: US 7,980,922 B2
(45) Date of Patent: Jul. 19, 2011

(54) METHOD AND SYSTEM FOR CONTROLLING CHEMICAL MECHANICAL POLISHING BY CONTROLLABLY MOVING A SLURRY OUTLET

(75) Inventors: Axel Kiesel, Chemnitz (DE); Uwe Stoeckgen, Dresden (DE); John Lampett, Dresden (DE); Heiko Wundram, Floeha (DE)

(73) Assignee: Advanced Micro Devices, Inc., Austin, TX (US)

( * ) Notice: Subject to any disclaimer, the term of this patent is extended or adjusted under 35 U.S.C. 154(b) by 883 days.

(21) Appl. No.: 11/758,704

(22) Filed: Jun. 6, 2007

(65) Prior Publication Data

US 2008/0132152 A1 Jun. 5, 2008

(30) Foreign Application Priority Data

Nov. 30, 2006 (DE) ..... 10 2006 056 623

(51) Int. Cl.
*B24B 49/00* (2006.01)
*B24B 51/00* (2006.01)

(52) U.S. Cl. ..... 451/5; 451/7; 451/8; 451/10; 451/41; 451/60; 451/446

(58) Field of Classification Search ..... 451/5, 7, 451/8, 10, 11, 21, 36, 60, 65, 285, 286, 287, 451/288, 289, 290, 446, 41
See application file for complete search history.

(56) References Cited

U.S. PATENT DOCUMENTS

| | | | | |
|---|---|---|---|---|
| 5,196,353 | A * | 3/1993 | Sandhu et al. | 438/5 |
| 5,709,593 | A * | 1/1998 | Guthrie et al. | 451/287 |
| 5,851,135 | A * | 12/1998 | Sandhu et al. | 451/5 |
| 5,984,764 | A * | 11/1999 | Saito et al. | 451/56 |
| 6,149,508 | A * | 11/2000 | Vanell et al. | 451/72 |
| 6,227,947 | B1 * | 5/2001 | Hu et al. | 451/56 |
| 6,315,635 | B1 * | 11/2001 | Lin | 451/7 |
| 6,319,099 | B1 * | 11/2001 | Tanoue et al. | 451/60 |
| 6,464,562 | B1 * | 10/2002 | Chen | 451/5 |
| 6,722,943 | B2 * | 4/2004 | Joslyn | 451/5 |
| 7,018,269 | B2 * | 3/2006 | Anderson | 451/5 |
| 7,050,880 | B2 * | 5/2006 | de Roover et al. | 700/121 |
| 7,297,047 | B2 * | 11/2007 | Lee et al. | 451/5 |
| 7,437,206 | B2 * | 10/2008 | Roover et al. | 700/121 |
| 2003/0027505 | A1 | 2/2003 | Withers et al. | 451/60 |
| 2005/0181709 | A1 | 8/2005 | Jiang et al. | 451/41 |
| 2006/0105678 | A1 | 5/2006 | Kohama et al. | 451/5 |

OTHER PUBLICATIONS

Translation of Official Communication from German Patent Office for German Patent Application No. 10 2006 056 623.8-14 dated Nov. 21, 2007.

* cited by examiner

*Primary Examiner* — Timothy V Eley
(74) *Attorney, Agent, or Firm* — Williams, Morgan & Amerson, P.C.

(57) ABSTRACT

A system and a method of operating a chemical mechanical polishing (CMP) system comprises a slurry delivering unit configured for locally varying the supply of slurry while polishing the substrate. To this end, the slurry delivering unit may comprise at least one slurry outlet over a polishing pad of the CMP system, wherein the at least one slurry outlet is controllably movable to distribute slurry over the polishing pad.

22 Claims, 3 Drawing Sheets

METHOD AND SYSTEM FOR CONTROLLING CHEMICAL MECHANICAL POLISHING BY CONTROLLABLY MOVING A SLURRY OUTLET

BACKGROUND OF THE INVENTION

1. Field of the Invention

The present disclosure relates to the field of fabrication of microstructures, and, more particularly, to a tool for chemically mechanically polishing substrates, bearing for instance a plurality of dies for forming integrated circuits, wherein the tool is equipped with a slurry delivering unit for delivering slurry onto the surface of a polishing pad of the tool.

2. Description of the Related Art

In microstructures, such as integrated circuits, a large number of elements, e.g., transistors, capacitors and resistors, are fabricated on a single substrate by depositing semi-conductive, conductive and insulating material layers and patterning those layers by photolithography and etch techniques. Frequently, the problem arises that the patterning of a subsequent material layer is adversely affected by a pronounced topography of the previously formed material layers. Moreover, the fabrication of microstructures often requires the removal of excess material of a previously deposited material layer. For example, individual circuit elements may be electrically connected by means of metal lines that are embedded in a dielectric, thereby forming what is usually referred to as a metallization layer. In modern integrated circuits, a plurality of such metallization layers is typically provided, wherein the layers are stacked on top of each other to maintain the required functionality. The repeated patterning of material layers, however, creates an increasingly non-planar surface topography, which may cause deterioration of subsequent patterning processes, especially for microstructures including features with minimum dimensions in the submicron range, as is the case for sophisticated integrated circuits.

It has thus turned out to be necessary to planarize the surface of the substrate between the formation of specific subsequent layers. A planar surface of the substrate is desirable for various reasons, one of them being the limited optical depth of the focus in photolithography which is used to pattern the material layers of microstructures.

Chemical mechanical polishing (CMP) is an appropriate and widely used process to remove excess material and to achieve global planarization of a substrate. In the CMP process, a wafer is mounted on an appropriately formed carrier, a so-called polishing head, and the carrier is moved relative to a polishing pad while the wafer is in contact with the polishing pad. A slurry is supplied to the polishing pad during the CMP process and contains a chemical compound reacting with the material or materials of the layer to be planarized by, for example, converting into a reaction product that may be less stable and easier removed, while the reaction product, such as a metal oxide, is then mechanically removed with abrasives contained in the slurry and/or the polishing pad. To obtain a required removal rate while at the same time achieving a high degree of planarity of the layer, parameters and conditions of the CMP process must be appropriately chosen, thereby considering factors such as construction of the polishing pad, type of slurry, pressure applied to the wafer while moving relative to the polishing pad and the relative velocity between the wafer and the polishing pad. The removal rate further significantly depends on the temperature of the slurry, affected by the amount of friction created by the relative motion of the polishing pad and the wafer, the degree of saturation of the slurry with ablated particles and, in particular, the state of the polishing surface of the polishing pad.

Most polishing pads are formed of a cellular microstructure polymer material having numerous voids which are filled with slurry during operation. A densification of the slurry within the voids occurs due to the absorbed particles that have been removed from the substrate surface and accumulated in the slurry. As a consequence, the removal rate steadily decreases, thereby disadvantageously affecting the reliability of the planarizing process and thus reducing yield and reliability of the completed semiconductor devices.

To partly overcome this problem, a so-called pad conditioner is typically used that "reconditions" the polishing surface of the polishing pad. The pad conditioner includes a conditioning surface that may be comprised of a variety of materials, e.g., diamond that is embedded in a resistant material. In such cases, the exhausted surface of the pad is ablated and/or reworked by the relatively hard material of the pad conditioner once the removal rate is assessed to be too low. In other cases, as in sophisticated CMP apparatus, the pad conditioner is continuously in contact with the polishing pad while the substrate is polished.

In modern integrated circuits, process requirements concerning uniformity of the CMP process are very strict so that the state of the polishing pad has to be maintained as constant as possible over the entire area of a single substrate as well as for the processing of as many substrates as possible. Consequently, the pad conditioners are usually provided with a drive assembly and a control unit that allow the pad conditioner, that is, at least a carrier including the conditioning surface, to be moved with respect to the polishing head and the polishing pad to rework the polishing pad substantially uniformly while avoiding interference with the movement of the polishing head. Therefore, one or more electric motors are typically provided in the conditioner drive assembly to rotate and/or sweep the conditioning surface suitably.

One problem with conventional CMP systems resides in the fact that a wafer removal profile, as well as a wafer removal rate, depends on many factors, e.g., the type of slurry, the slurry thickness, the temperature of the slurry, the pressure applied to the wafer while moving relative to the polishing pad, the relative velocity between the wafer and the polishing pad and the curvature of the wafer. Controlling a conventional CMP system therefore requires complex controlling of multiple parameters. Moreover, the deterioration of one or more of the consumables of a CMP renders it difficult to maintain process stability and to reliably predict an optimum time point for consumable replacement. Generally, replacing the consumables at an early stage significantly contributes to the cost of ownership and a reduced tool availability, whereas a replacement in a very advanced stage of the consumables of a CMP system may jeopardize process stability.

The present disclosure is directed to various systems and methods that may avoid, or at least reduce, the effects of one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the subject matter disclosed herein is directed to a technique for controlling a CMP system by locally varying a supply of slurry while polishing a substrate.

According to one illustrative embodiment disclosed herein, a system for chemical mechanical polishing comprises a controllably movable polishing head configured to receive and hold in place a substrate. A polishing pad is mounted on a platen that is coupled to a drive assembly. At least one slurry delivering unit is configured for a locally varying supply of slurry while polishing said substrate.

Another illustrative embodiment is directed to a technique for controlling a CMP system on the basis of at least one process parameter related to the chemical mechanical polishing of a substrate with the CMP system, by effecting a controllable distribution of slurry over the polishing pad. To his end, a process parameter may be any parameter which is related to or which affects the chemical mechanical polishing, e.g., a type of slurry, a slurry thickness, a temperature of the slurry, a slurry distribution over the polishing pad, a pressure applied to the wafer while moving relative to the polishing pad, a relative velocity between the wafer and the polishing pad, a curvature of the wafer, a wafer removal profile, an endpoint of polishing, a friction coefficient of the polishing pad, etc.

According to another illustrative embodiment, a system for chemical mechanical polishing comprises a controllably movable polishing head configured to receive and hold in place a substrate. A polishing pad is mounted on a platen that is coupled to a drive assembly. The system further comprises at least one slurry delivering unit having at least one controllably movable slurry outlet.

In accordance with still another illustrative embodiment, a method of operating a chemical mechanical polishing (CMP) system comprises polishing a substrate and locally varying the supply of slurry while polishing the substrate.

In accordance with yet another illustrative embodiment, a method of operating a chemical mechanical polishing (CMP) system comprises taking into account at least one process parameter related to the chemical mechanical polishing of a substrate and moving, in response to the process parameter, at least one slurry outlet over a polishing pad of the CMP system while polishing, thereby distributing slurry over the polishing pad.

BRIEF DESCRIPTION OF THE DRAWINGS

The disclosure may be understood by reference to the following description taken in conjunction with the accompanying drawings, in which like reference numerals identify like elements, and in which.

Figure 1A:
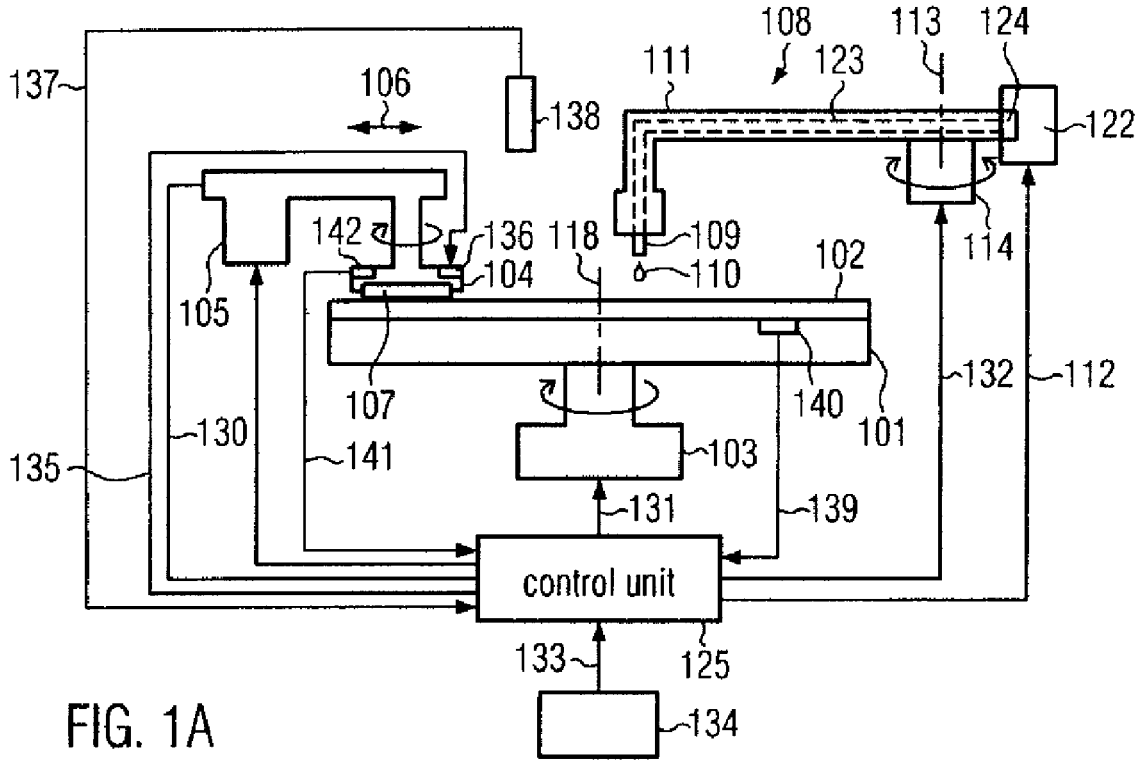
FIG. 1A shows a sketch of side view of a CMP system according to an illustrative embodiment disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

With reference to the drawings, further illustrative embodiments will now be described in more detail. In the following, parts of a system for chemical mechanical polishing (CMP) are discussed in greater detail with regard to particular embodiments. However, respective parts of the other embodiments may be configured accordingly.

Generally, the subject matter disclosed herein is based on the principle of controlling a CMP system by locally varying the supply of slurry while polishing a substrate. Hence, a desired slurry distribution can be obtained on a polishing pad of the CMP system. According to one embodiment, the desired slurry distribution is obtained by locally varying the slurry output according to a fixed slurry output program according to which the slurry output is locally varied with time. According to other embodiments, the desired slurry distribution is obtained by measuring one or more parameters and controlling the slurry output in response to the measured at least one parameter. The locally varying slurry output can be obtained by controlling at least one controllably movable slurry outlet. According to other embodiments, the locally varying slurry output can be obtained by any other suitable means, e.g., by a slurry distribution device which has at least two slurry outlets which can be selectively activated to dispense slurry in order to locally vary the slurry output. While the aforementioned embodiments can provide a locally varying slurry output, the local variation of which can vary with time, according to still another embodiment, the slurry distribution device is configured to provide a locally varying but temporally fixed slurry distribution.

Figure 1B:
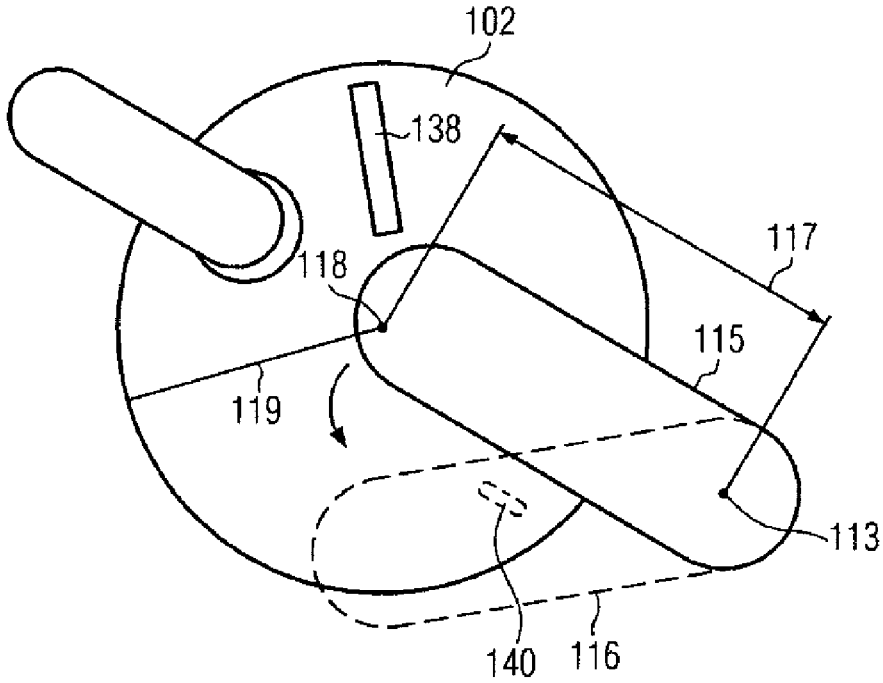
FIG. 1B shows a elevated view of the CMP system of FIG. 1A.

FIGS. 1A and 1B schematically represent a CMP system 100. The CMP system 100 comprises a platen 101 on which a polishing pad 102 is mounted. The platen 101 is rotatably attached to a drive assembly 103 that is configured to rotate the platen 101 at any desired revolution between a range of zero to, e.g., some hundred revolutions per minute. Although a specific direction of rotation is given in FIG. 1, as well as in the other drawings, it should be understood that the specified direction of rotation is only exemplary. A polishing head 104 is coupled to a drive assembly 105, which is adapted to rotate the polishing head 104 and to move it radially with respect to the platen 101 as is indicated by 106. Furthermore, the drive assembly 105 may be configured to move the polishing head 104 in any desired manner necessary to load and unload a substrate 107, which is received and held in place by the polishing head 104.

In other cases, the movement of the slurry outlet 109 may be controlled such that an even slurry distribution over the radius of the polishing pad 102 is obtained before the polishing pad 102 moves past the substrate 107. Alternatively, the movement of the slurry outlet 109 may be controlled such that an even slurry distribution over the diameter of the wafer 102 is obtained.

According to one illustrative embodiment, the slurry delivering unit 108 comprises a controllably movable slurry distribution device 111, wherein the at least one slurry outlet 109 is fixed at the slurry distribution device 111.

In the embodiment shown in FIGS. 1A and 1B, the controllably movable slurry distribution device 111 is rotatable about an axis of rotation 113, or, in other embodiments, the distribution device 111 may additionally or alternatively be movable in a linear direction, as will be described later with reference to FIG. 2. The controllably movable distribution device 111 may be provided in the form of a rotatable slurry arm, as shown in FIGS. 1A and 1B. Further, a drive assembly 114 for rotatably driving the movable distribution device 111 is provided. In other embodiments, the drive assembly may additionally or alternatively be configured for driving the movable distribution device in a linear direction, as will be described later with reference to FIG. 2.

Drive assembly 114 and movable distribution device 111 may be configured to provide a controlled movement of the movable distribution device 111 between a first position, indicated at 115, where the slurry outlet 109 is located in an inner position, and a second position, indicated at 116, where the slurry outlet is located in an outer position. For example, as depicted in FIG. 1B, the first position 115 can be located at or close to a center of the platen 101, whereas the second position 116 can be located at or close to an outer rim of the platen 101.

The rotational axis 113 of the movable distribution device 111 may be disposed at a distance 117 from a rotational axis 118 of the platen 101 which is larger than the radius 119 of the platen 101, as shown in FIG. 1B. Alternatively, the rotational axis 113 of the movable distribution device 111 may be disposed at a distance from the rotational axis 118 of the platen 101 which is smaller than the radius 119 of the platen 101.

The rotational axis 113 of the movable distribution device 111 and the rotational axis 118 of the platen 101 may be arranged in parallel. However, in other embodiments, the rotational axis 113 of the movable distribution device 111 may be tilted with respect to the rotational axis 118 of the platen 101.

Each of the drive assemblies 103, 105, 114 comprises a motor, typically an electric motor, of any appropriate construction to impart the required functionality. For instance, each of the drive assemblies may include any type of DC or AC motor.

Each of drive assemblies, in particular the drive assembly 114 for moving the controllably movable distribution device 111, may be a sweep drive or may comprise a sweep drive, which allows controlling the slurry arm position with respect to the platen 101. Further, the drive assembly 114 for moving the controllably movable distribution device 111 may comprise one or more position sensors for controlling the position of the controllably movable distribution device 111 with respect to the platen 101.

Each slurry delivering unit 108 may have an associated slurry reservoir 122 and a slurry transport assembly for transporting the slurry to the respective slurry outlet 109. The slurry transport assembly shown in FIG. 1A comprises a slurry flow path 123, e.g., a tube, and a pump 124 for pumping the slurry 110 through the slurry flow path 123 to the respective slurry outlet 109. The slurry volume per time unit dispensed from the slurry outlet 109 can be varied by varying the pump throughput of the pump 124. Alternatively or additionally, an additional device for controlling the slurry volume per time unit, e.g., a valve (not shown), may be provided in the slurry flow path 123.

A CMP system may comprise a control unit for controlling the locally varying supply of slurry. According to one illustrative embodiment, the control unit may be provided for controlling the movement of the at least one slurry outlet 109. In the following, the entirety of the control units or sub-control units of the CMP system are referred to as control unit 125. Accordingly, the control unit 125 may be comprised of two or more sub-units that may communicate with appropriate communications networks, such as cable connections, wireless networks and the like. The control unit 125 or one or more sub-control units may be implemented by a separate control device, such as a personal computer (PC), or as part of a facility management system. For instance, the control unit 125 may comprise a sub-control unit as provided in conventional CMP systems so as to appropriately provide control signals 130, 131 to the drive assemblies 103, 105 to coordinate the movement of the polishing head 104, the polishing pad 102 and, if provided, a pad conditioning member.

The control unit 125 may be configured to provide control signals 112 to the slurry delivering unit 108 to appropriately control the slurry volume dispensed by the slurry delivering unit 108 in response to some or all of the process parameters taken into account for controllably moving the at least one slurry outlet 109. In other cases, the control unit 125 may provide respective control signals to the slurry delivering unit 108 to generate a predetermined dynamic behavior.

The control unit 125 may also be configured to provide appropriate control signals 132 to the drive assembly 114 for moving the movable slurry distribution device 111. In one embodiment, the control unit 125 is configured to provide the control signals to these drive assemblies 114 on the basis of at least one process parameter related to the chemical mechanical polishing of a substrate with the CMP system. A process parameter may be at least one of a predetermined process parameter retrieved from a data storage, a process parameter entered by a user, a process parameter generated on the basis of stored data and/or measured signals, a continuously measured signal, an intermittently measured signal, etc.

An example of a process parameter is a wafer removal profile 133. Accordingly, a CMP system may comprise a wafer removal profile measurement assembly 134 for measuring a wafer removal profile 133, as shown in FIG. 1A. The control system 125 is configured to automatically control the movement of the at least one slurry outlet 109 in response to the measured wafer removal profile 133.

A further example of a process parameter is a slurry distribution 137 over the polishing pad 102, in particular a radial slurry distribution over the polishing pad 102. Accordingly, a CMP system may comprise a slurry distribution measurement assembly 138 for measuring a slurry distribution over the polishing pad 102, as shown in FIGS. 1A and 1B. In particular, the slurry distribution measurement assembly 138 may be configured to measure a slurry distribution 137 over the polishing pad 102 in a radial direction of the polishing pad 102 as shown in FIG. 1B. The control system 125 is configured to automatically control the movement of the at least one slurry outlet 109 in response to the measured slurry distribution 137.

A further example of a process parameter is a layer thickness 139 of a specific layer on the substrate 107. Accordingly, a CMP system may comprise the layer thickness measurement assembly 140 for measuring a layer thickness of a layer on the substrate 107 as shown in FIGS. 1A and 1B. Accordingly, the control system 125 is configured to automatically control the movement of the at least one slurry outlet 109 in response to the measured layer thickness 139. A CMP system may further comprise an endpoint determination assembly for determining an endpoint of polishing. Accordingly, the control system 125 is configured to automatically control the CMP system in response to an determined endpoint of polishing. The endpoint of polishing may be derived from the layer thickness 139. In the embodiment of FIGS. 1A and 1B, the layer thickness measurement assembly 140, together with an appropriate configuration of the control system 125, is used as an endpoint determination assembly.

A further example of a process parameter is a process temperature 141. Accordingly, a CMP system may comprise a process temperature measurement assembly 142 for measuring the process temperature of the polishing process. Accordingly, the control system 125 is configured to automatically control the movement of the at least one slurry outlet 109 in response to the process temperature 141.

Preferably, the assemblies for measuring a process parameter are inline measuring assemblies, i. e., the wafer does not need to be taken out of the process line for performing the respective measurement.

The signal paths of the process parameters 133, 135, 137, 139, 141 and the control signals 130, 131, 132 may be of any appropriate kind, e.g., formed by wire, wireless communication paths, optical communication paths, etc. The signal paths are shown exemplarily in FIG. 1A and have been omitted for the sake of clarity of the drawings in the remaining figures. Further, measuring assemblies are shown only in FIGS. 1A and 1B. However, it should be understood that each of the embodiments shown in FIGS. 2, 3, 4 and 5 may comprise one or more of the measurement assemblies disclosed herein or one or more other assemblies suitable for providing a process parameter.

A process parameter may be a measured process parameter, as discussed above, or a target process parameter which is to be obtained by appropriately controlling the CMP system, in particular by appropriately controlling the at least one slurry outlet 109. An example of such a target process parameter is a predetermined, e.g., an even, slurry distribution over the wafer diameter while polishing. Without restricting the invention to the following discussion, it is believed that such an even slurry distribution over the wafer diameter can be obtained by way of performing experiments or computer simulations for establishing a table relating specific process parameters, such as a wafer profile, a process temperature, a relative speed of the polishing pad 102 and the polishing head 104, a force applied between the polishing head 104 (wafer 107) and polishing pad 102, etc., to a radial slurry distribution which has to be established on the polishing pad in front of the polishing head in order to obtain the desired slurry distribution under the polishing head, between the wafer 107 and the polishing pad 102.

In accordance with the subject matter disclosed herein, the process parameters have been used to control the movement of the at least one slurry outlet. However, it should be understood that each process parameter or each combination of process parameters can be used not only for controlling the movement of the at least one slurry outlet but also for controlling, e.g., the slurry delivering unit as a whole and in particular for controlling the slurry transport assembly 123, 124, or for controlling any other part of the CMP system. Hence, the control unit 125 may be configured accordingly. In particular, the control unit 125 may be further configured to control the slurry transport assembly 123, 124 in response to the at least one process parameter in order to obtain a desired slurry distribution, e.g., an even slurry distribution over the platen radius or the wafer diameter.

The control unit 125 may further be configured to control any other part of the CMP system. One example is zone pressures 135 which are established between the polishing pad 102 and specific zones of the wafer 107. Accordingly, the CMP system shown in FIGS. 1A and 1B comprises a zone pressure establishing assembly 136 for establishing zone pressures according to the respective control signals 135 of the control unit 125. The control unit 125 may be configured to automatically control the movement of the at least one slurry outlet 109 in response to control signals for controlling other parts of the CMP system. Accordingly, with regard to the above example, the control unit 125 may be configured to control the movement of the at least one slurry outlet 109 in response to the zone pressures 135.

Figure 2:
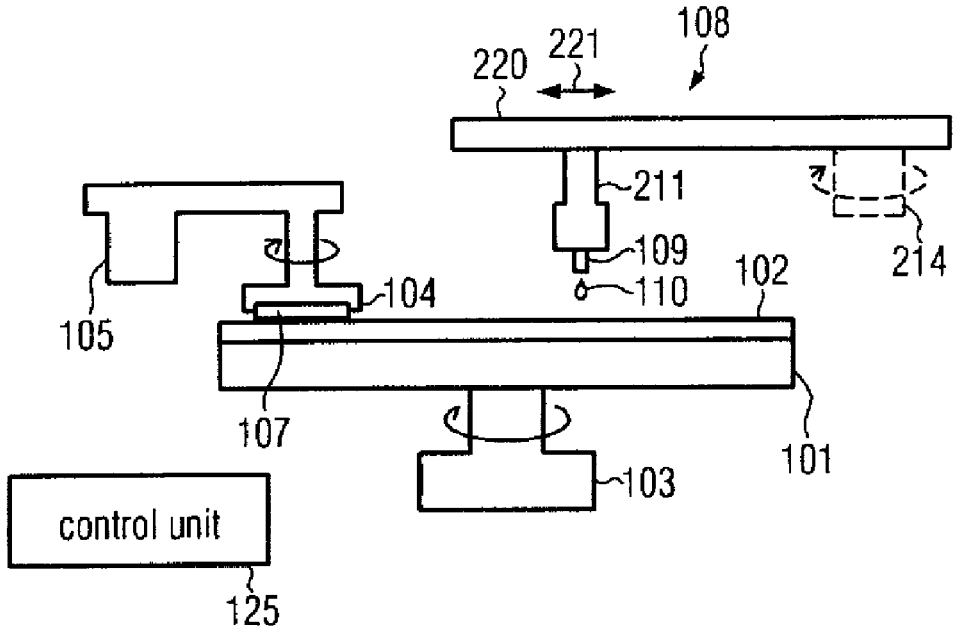
FIG. 2 shows a sketch of a side view of a CMP system according to another illustrative embodiment disclosed herein.

According to a further embodiment shown in FIG. 2, a controllably movable slurry distribution device 211 is coupled to a linear drive assembly 220 for linearly moving the controllably movable slurry distribution device 211 over the polish platen 101. To this end, the controllably movable slurry distribution device 211 may be movably mounted on a support (not shown) for guiding the movable slurry distribution device 211. The linear drive assembly may be oriented in a radial direction, indicated at 221, with respect to the polish platen 101, the controllably movable distribution device 211 being thereby controllably movable in the radial direction 221. In other embodiments, the linear drive assembly may be oriented in any other direction which is suitable to move the slurry distribution device over the polish platen such that a desired slurry distribution can be obtained.

Further, in still another embodiment, the linear drive assembly 220 may be attached to a rotational drive assembly 214 (shown in phantom in FIG. 2) that is configured to rotatably drive the linear drive assembly 220. The drive assembly 214 for rotationally driving the linear drive assembly 220 may be configured similar to the drive assembly 114 for rotatably driving the movable distribution device 111 of the embodiment depicted in FIG. 1. It should be understood that an embodiment having a distribution device 211 which is linearly movable can be provided with the rotational drive assembly 214 or without the rotational drive assembly 214.

The drive assembly 220 for linearly moving the slurry distribution device 211 may be provided in a highly space-efficient manner. The drive assemblies 214 and 220 may be configured as the drive assembly 114 described with regard to FIGS. 1A and 1B.

While the embodiments shown in FIGS. 1A, 1B and 2 have only one slurry delivering unit 108, a CMP system according to the present disclosure may comprise two or more of the slurry delivering units 108 acting on a single polishing platen 101. Two (or more) slurry delivering units 108 may distribute the same slurry. Moreover, two or more slurry delivering units 108 allow for the slurry delivering units 108 distributing different slurries or different slurry components. In this case, the composition of the slurry on the polishing pad 102 can be varied over the polishing pad area, in particular in a radial direction of the polishing platen 101. For example, an uneven radial concentration profile of different slurry components can be reduced by delivering the slurry components at appropriate positions, in particular appropriate radial positions on the polishing pad 102.

Figure 3:
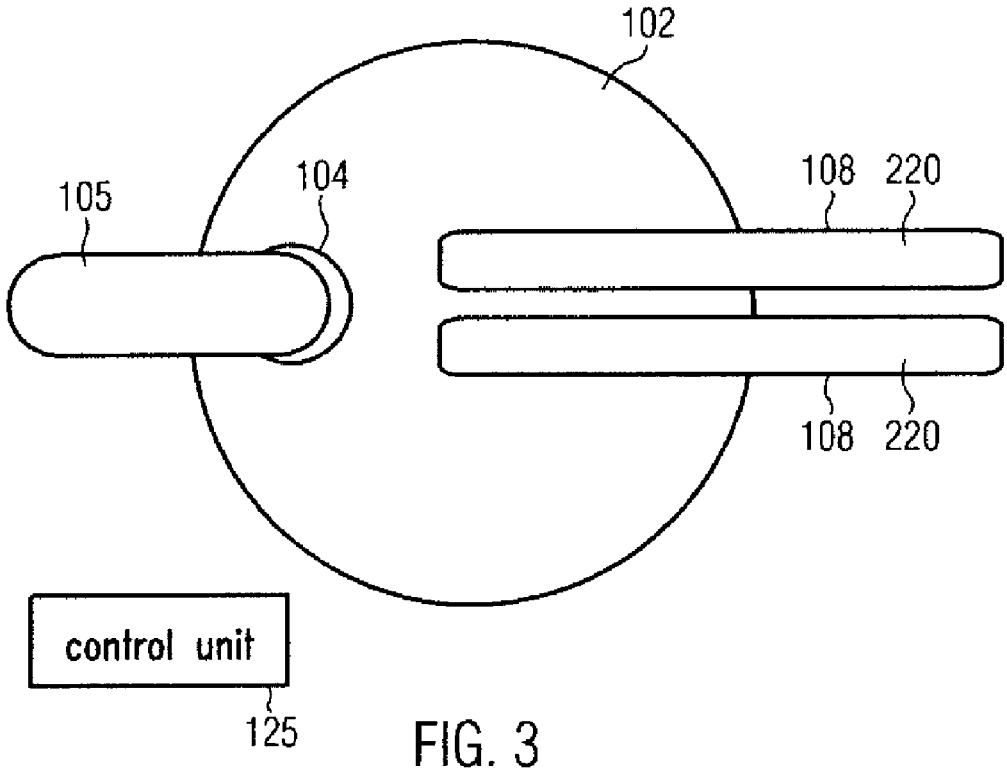
FIG. 3 shows a sketch of a elevated view of a CMP system according to still another illustrative embodiment disclosed herein.

In the embodiment of FIG. 3, showing a CMP system with two slurry delivering units 108, each slurry delivering unit 108 comprises a linearly movable slurry distribution device 211, e.g., a slurry distribution device 211 as shown in FIG. 2. The two slurry delivering units 108 are arranged in parallel. Alternatively, the two (or more) slurry delivering units may be arranged in a tilted configuration with respect to each other.

Referring to FIG. 3, a CMP system in accordance with one illustrative embodiment may comprise at least two of the slurry delivering units 108 and control unit 125 operable to control the slurry delivering units 108 so as to distribute different slurry volumes per time unit.

Figure 4:
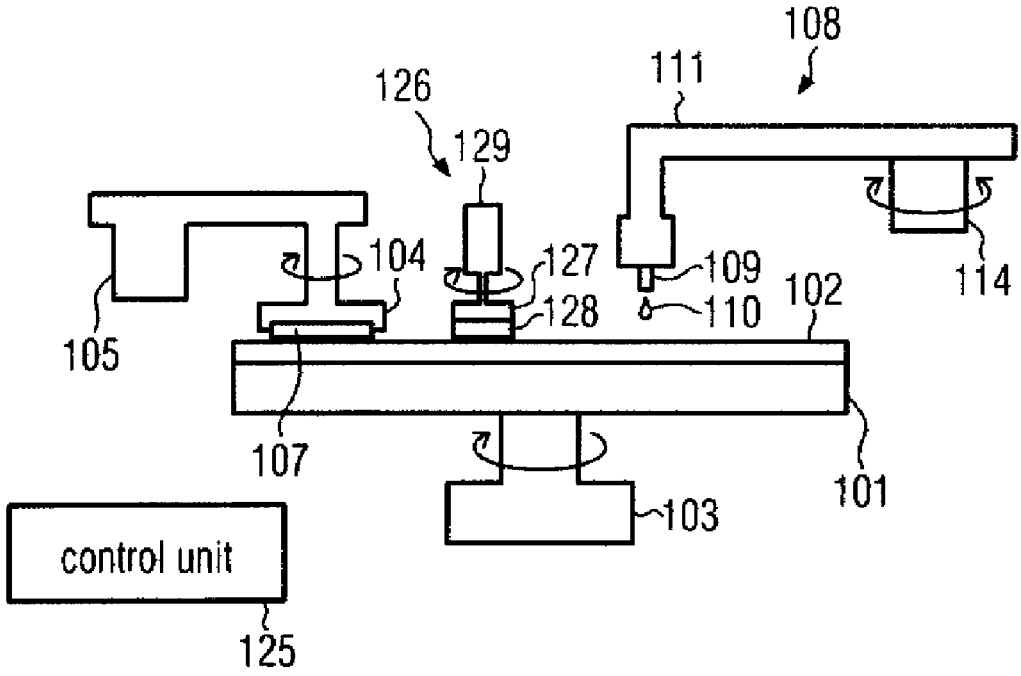
FIG. 4 shows a sketch of a side view of a CMP system according to still another illustrative embodiment disclosed herein.

A CMP system in accordance with the present disclosure, in particular of the CMP systems shown in the drawings, may comprise a pad conditioning assembly 126, as is exemplarily shown in FIG. 4. The pad conditioning assembly 126 may comprise a head 127 attached to which is a conditioning member 128 including a conditioning surface which comprises an appropriate material, such as diamond. The conditioning surface may have a specified texture designed to obtain an optimum conditioning effect on the polishing pad 102. The head 127 is coupled to a drive assembly 129 which is configured to rotate the head 127 and/or move it radially with respect to the platen 101. Moreover, the drive assembly 129 may be configured so as to provide the head 127 with any movability required for yielding the appropriate conditioning effect.

Figure 5:
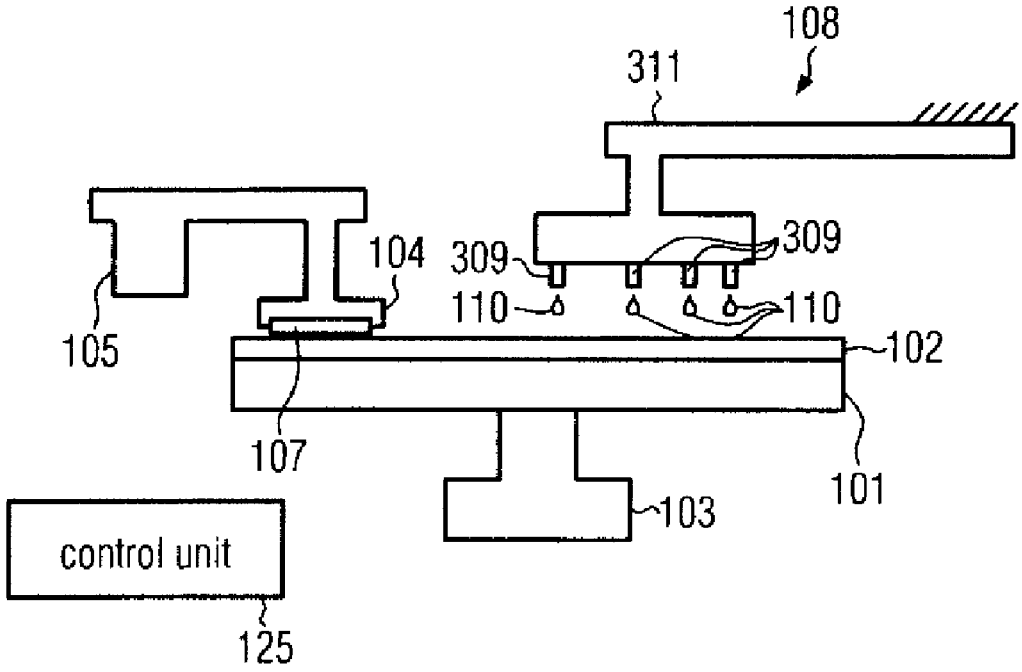
FIG. 5 shows a sketch of a side view of a CMP system according to still another illustrative embodiment disclosed herein.

Referring to FIG. 5, a CMP system in accordance with one illustrative embodiment may comprise a slurry delivering unit 108 having a stationary, i.e., a spatially fixed slurry distribution device 311. The stationary slurry distribution device 311 has at least two spatially fixed slurry outlets 309 which produce a locally varying supply of slurry 110. The temporally fixed but locally varying slurry supply has the advantage of a relatively inexpensive slurry delivering unit 108. Except for the slurry delivering unit 108, the CMP system of FIG. 4 is similar to the embodiment shown in FIG. 1 and the corresponding parts share the same reference numbers.

As a result, the subject matter disclosed herein provides a system and a method for enhancing the performance of a CMP system or of a process tool chain including a CMP system, since at least one slurry delivering unit configured for a locally varying supply of slurry while polishing said substrate is used to optimize the slurry distribution while polishing. In particular, one or more slurry delivering units may comprise at least one controllably movable slurry outlet. The movable slurry outlet may be implemented by fixing the at least one slurry outlet at a controllably movable slurry distribution device which can be controllably moved above the platen area while polishing. The slurry distribution device is movable linearly and/or rotationally. There can be one or more controllably movable slurry distribution devices, distributing different slurry components and/or slurry volumes above the platen area. While polishing, the movement of the slurry outlet(s) can be controlled and changed automatically, depending on process conditions such as inline wafer removal profile measurement, even slurry distribution over platen radius or wafer diameter, process temperature, minimizing slurry consumption, reducing defects due to uneven slurry distribution over wafer area, and others. Thus, the cost of ownership, due to a more efficient usage of consumables, is reduced while tool availability is enhanced. Using the controllably movable slurry outlet also improves the process stability in that CMP specific variations may be compensated for with the CMP tool.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system for chemical mechanical polishing comprising:

a controllably movable polishing head configured to receive and hold in place a substrate;

a polishing pad mounted on a platen that is coupled to a drive assembly, wherein said controllably movable polishing head is controllably movable in a substantially radial direction with respect to a surface of said platen;

at least one slurry delivering unit comprising at least one controllably movable slurry outlet and configured for a locally varying supply of slurry while polishing said substrate a control system for controlling the movement of said at least one slurry outlet; and a slurry distribution measurement assembly for measuring a slurry distribution over said polishing pad, wherein said control system is configured to automatically control movement of said at least one slurry outlet in response to said measured slurry distribution.

2. The system of claim 1, wherein said slurry delivering unit comprises a controllably movable slurry distribution device, wherein said at least one slurry outlet is fixed at said slurry distribution device.

3. The system of claim 2, wherein the controllably movable slurry distribution device is coupled to a drive assembly for rotatably driving said controllably movable slurry distribution device about an axis of rotation.

4. The system of claim 3, wherein said controllably movable slurry distribution device is rotatable between two angular positions.

5. The system of claim 3, further comprising a sweep drive for rotatably driving said controllably movable slurry distribution device.

6. The system of claim 3, wherein said axis of rotation of said controllably movable slurry distribution device and an axis of rotation of said platen are arranged in parallel.

7. The system of claim 2, wherein said controllably movable slurry distribution device is coupled to a drive assembly for linearly moving said controllably movable slurry distribution device over said polish platen.

8. The system of claim 1, further comprising at least two controllably movable slurry outlets.

9. The system of claim 1, comprising at least two of said slurry delivering units, wherein said control system operable to control said slurry delivering units so as to distribute different slurry volumes per time unit.

10. The system of claim 1, further comprising a wafer removal profile measurement assembly for measuring a wafer removal profile, wherein said control system is configured to automatically control the movement of said at least one slurry outlet in response to said measured wafer removal profile.

11. The system of claim 1, further comprising a layer thickness measurement assembly for measuring the thickness of a layer on said wafer, wherein said control system is configured to automatically control the movement of said at least one slurry outlet in response to said measured layer thickness.

12. The system of claim 1, further comprising a process temperature determination assembly for determining a process temperature of polishing, wherein said control system is configured to automatically control the movement of said at least one slurry outlet in response to said measured process temperature.

13. The system of claim 1, wherein the control system is configured for controlling a part of the CMP system by providing respective control signals to said part of the CMP system and the control system is configured to automatically control the movement of said at least one slurry outlet in response to said control signals.

14. The system of claim 1, further comprising a pad conditioning assembly, said pad conditioning assembly being adapted to condition said polishing pad.

15. A system for performing chemical mechanical polishing of a substrate, said system comprising:

a polishing pad operatively coupled to a platen, wherein said platen is operatively coupled to a platen drive assembly, said platen drive assembly being adapted to rotatably drive said platen about a first axis of rotation;

a polishing head adapted to receive and hold in place said substrate, wherein said polishing head is operatively coupled to a polishing head drive assembly that is adapted to rotatably drive said polishing head about a second axis of rotation, said polishing head drive assembly being further adapted to controllably move said polishing head in a generally radial direction with respect to a surface of said platen;

at least one slurry delivering unit adapted to locally vary a supply of a slurry while performing said chemical mechanical polishing of said substrate, wherein said at least one slurry delivering unit comprises a controllably movable slurry distribution device operatively coupled to a slurry distribution device drive assembly, said controllably movable slurry distribution device comprising at least one slurry outlet; and a slurry distribution measurement assembly for measuring a slurry distribution over said polishing pad, wherein movement of said at least one slurry outlet is automatically controlled in response to said measured slurry distribution.

16. The system of claim 15, wherein said slurry distribution device drive assembly is adapted to rotatably move said controllably movable slurry distribution device about a third axis of rotation, said controllably movable slurry distribution device being rotatable between at least two angular positions.

17. The system of claim 16, wherein said second and third axes of rotation are substantially parallel to one another.

18. The system of claim 15, wherein said slurry distribution device drive assembly is adapted to move said controllably movable slurry distribution device in a substantially linear path.

19. The system of claim 15, further comprising a control system operatively coupled to and adapted to control at least one of said platen drive assembly, said polishing head drive assembly, said slurry delivering unit, and said slurry distribution device drive assembly.

20. The system of claim 19, further comprising a pad conditioning assembly comprising a conditioning head, said condition head comprising a conditioning member that is adapted to condition said polishing pad, wherein said pad conditioning assembly is operatively coupled to a fourth drive assembly adapted to rotatably drive said conditioning head about a fourth axis of rotation, said fourth drive assembly being further adapted to controllably move said conditioning head in a generally radial direction with respect to a surface of said platen.

21. The system of claim 20, wherein said control system is operatively coupled to and adapted to control said fourth drive assembly.

22. A chemical mechanical polishing system adapted to polish a substrate, said system comprising:

a controllably movable polishing head adapted to receive and hold in place said substrate during a polishing operation;

a polishing pad mounted on a platen, wherein said platen is rotatably coupled to a drive assembly;

at least one slurry delivering unit adapted to provide a locally varying supply of slurry during said polishing operation, wherein said at least one slurry delivering unit comprises at least one controllably movable slurry outlet;

a slurry distribution measurement assembly adapted to measure a slurry distribution over said polishing pad; and a control system adapted to automatically control a movement of said at least one movable slurry outlet in response to said measured slurry distribution.

* * * * *